US006779448B2

(12) United States Patent
Brown et al.

(10) Patent No.: US 6,779,448 B2
(45) Date of Patent: Aug. 24, 2004

(54) METHOD FOR CONTINUOUSLY CHECKING THE PRODUCTION OF SECURITY PRINTING MACHINES, APPLICATION OF SAID METHOD AND DEVICE FOR PERFORMING THE METHOD

(75) Inventors: Stephen Brown, Etoy (CH); Eric Fivaz, Lausanne (CH)

(73) Assignee: KBA-Giori S.A., Lausanne (CH)

( * ) Notice: Subject to any disclaimer, the term of this patent is extended or adjusted under 35 U.S.C. 154(b) by 0 days.

(21) Appl. No.: 10/240,977

(22) PCT Filed: Apr. 11, 2001

(86) PCT No.: PCT/CH01/00235

§ 371 (c)(1),
(2), (4) Date: Oct. 7, 2002

(87) PCT Pub. No.: WO01/76875

PCT Pub. Date: Oct. 18, 2001

(65) Prior Publication Data

US 2003/0047100 A1 Mar. 13, 2003

(30) Foreign Application Priority Data

Apr. 11, 2000 (EP) ..... 00810316

(51) Int. Cl.[7] ..... B41F 31/03; B41F 31/06

(52) U.S. Cl. ..... 101/363; 101/350.1; 101/DIG. 34

(58) Field of Search ..... 121/350.1, 491, 121/DIG. 34, DIG. 45, 363, 364, 483, 484, DIG. 29; 347/7

(56) References Cited

U.S. PATENT DOCUMENTS

| | | | | | |
|---|---|---|---|---|---|
| 3,084,625 | A | * | 4/1963 | Gegenheimer et al. | 101/364 |
| 4,064,804 | A | * | 12/1977 | Schweitzer | 101/451 |
| 4,130,858 | A | * | 12/1978 | Hayakawa | 362/150 |
| 6,106,089 | A | * | 8/2000 | Wen et al. | 347/7 |
| 6,401,612 | B2 | * | 6/2002 | Koehler | 101/366 |

FOREIGN PATENT DOCUMENTS

| | | |
|---|---|---|
| EP | 0854035 A | 7/1998 |
| EP | 0965447 A | 12/1999 |

* cited by examiner

*Primary Examiner*—Andrew H. Hirshfeld
*Assistant Examiner*—Leo T. Hinze
(74) *Attorney, Agent, or Firm*—Clifford W. Browning; Woodard, Emhardt, Moriarty, McNett & Henry LLP

(57) ABSTRACT

The ink-agitator (1) is supported and guided by fixed means between pedestals (2) and (3) above an ink fountain containing security ink. It is driven in alternate movement on its guiding means and its tip is dipping into the ink. Bore (11) receives a detector head in the form of a transformer with primary winding arranged for normally producing a "zero" magnetic field, adjustable ferrite core place in such a manner that the "zero" magnetic field is obtained for a standard magnetic property of the security ink, and secondary winding going out of balance and issuing a signal if the magnetic property of the ink into which the tip of the ink-agitator is displaced undergoes modifications. The output signal is transmitted to feed line (4) with slide contact (6) whereas the ground pole is connected through wire (5) and sliding contact (7).

9 Claims, 7 Drawing Sheets

FIG.5
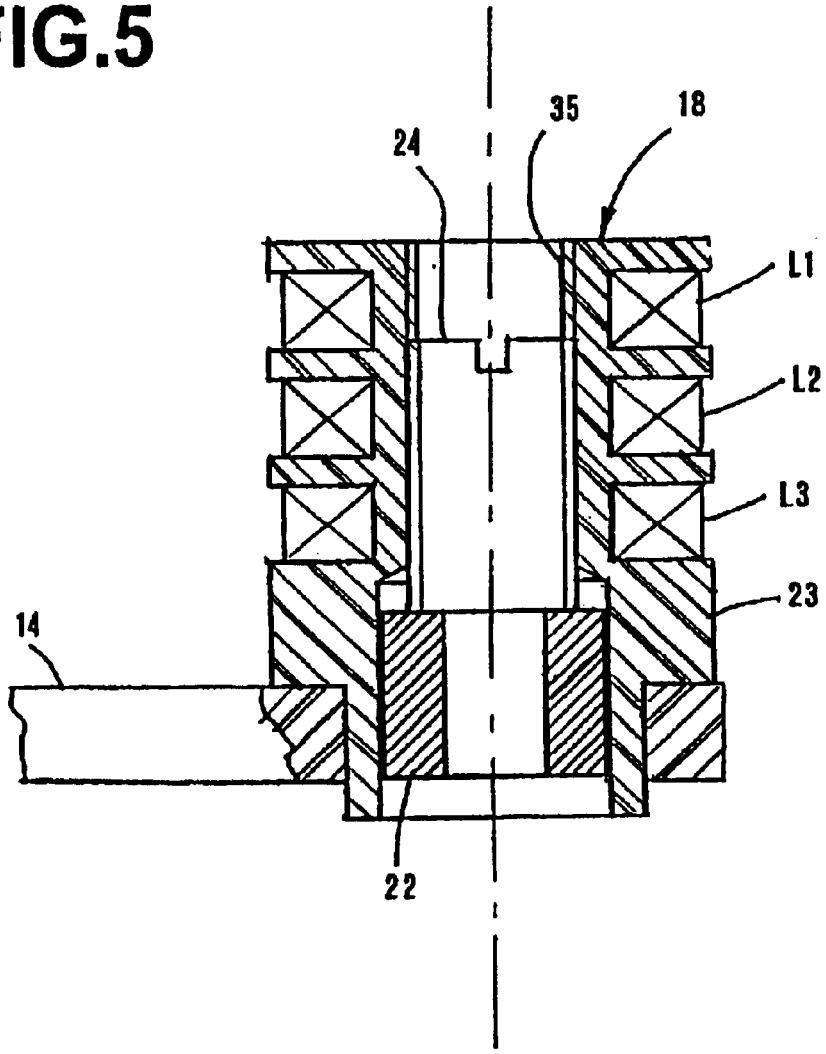
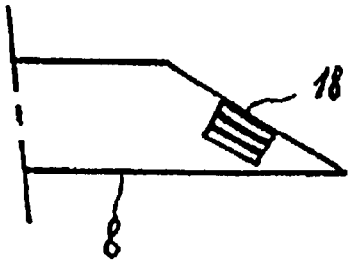
FIG.11
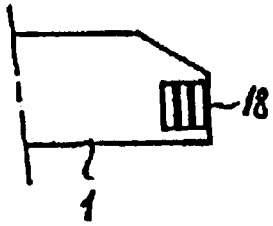
FIG.12

METHOD FOR CONTINUOUSLY CHECKING THE PRODUCTION OF SECURITY PRINTING MACHINES, APPLICATION OF SAID METHOD AND DEVICE FOR PERFORMING THE METHOD

FIELD OF THE INVENTION

It is common practice to include invisible security features into security ink. These features are used to enable end users—such as banks and central cash sorting companies—to identify false bank notes from true ones by inspecting these invisible features.

Up to now the usual practice has been to check the invisible properties of security ink used as security features at the end of the printing process. It results that the absence or defectiveness of such security features (which can happen for example if inks of a similar or identical colour but without the invisible properties are inadvertently mixed) is detected only once all the printing steps have been performed. In the case of bank notes printing, for example, the deficiency of the invisible security features may result in a large amount of waste notes or render the utility of the security feature null and void.

SUMMARY OF THE INVENTION

The present invention aims to remedy this drawback by constantly monitoring, in the ink fountain, the ink which is supposed to contain the invisible feature, whereby allowing to detect an eventual absence or a dilution of the invisible feature at the moment of printing. This enables rapid detection of the error and separation of the sheets with incorrect inking from those with good ink. The aim of the security feature is fully preserved and waste of printed sheets is avoided.

To this end, the present invention is concerned with a method for continuously checking the production of security printing machines comprising at least one ink fountain containing a security ink provided with an invisible feature, wherein an ink property detector with sensitivity in the range of said security feature is provided into a movable element being displaced into said ink fountain and in that the output of said detector is continuously collected and transmitted to a warning device.

The invention is also concerned with an application of said method for checking the production of printing machines comprising an ink fountain containing a security ink having a predetermined magnetic property, wherein an ink property detector provided with a ferromagnetic transducer sensitive to said magnetic property is used.

The invention is also concerned with a device for performing said method or said application, wherein the ink property detector is integrated to an ink-agitator comprising a finger element the tip of which extends into the ink fountain, said finger element being continuously displaced in said fountain and the ink property detector having an outlet connected to the warning device.

The integration of the ink property detector to an ink-agitator is particularly advantageous because it allows a detection in the fountain itself at the moment of printing, and also, since the detector is continuously moving into the ink fountain, because it allows the detection of the introduction of an inadequate ink at the very moment the ink is poured into the ink fountain.

BRIEF DESCRIPTION OF THE DRAWINGS

The invention is explained hereinafter in more details by reference to an exemplary embodiment represented in the attached drawings in which:

FIG. 5 is a cross-section of the ferrite core transformer which forms the main part of the transducer;

FIGS. 11 and 12 are partial schematical cross-sectional views of two variant embodiments of the end part of the finger of the ink-agitator.

DETAILED DESCRIPTION OF THE INVENTION

Figure 1:
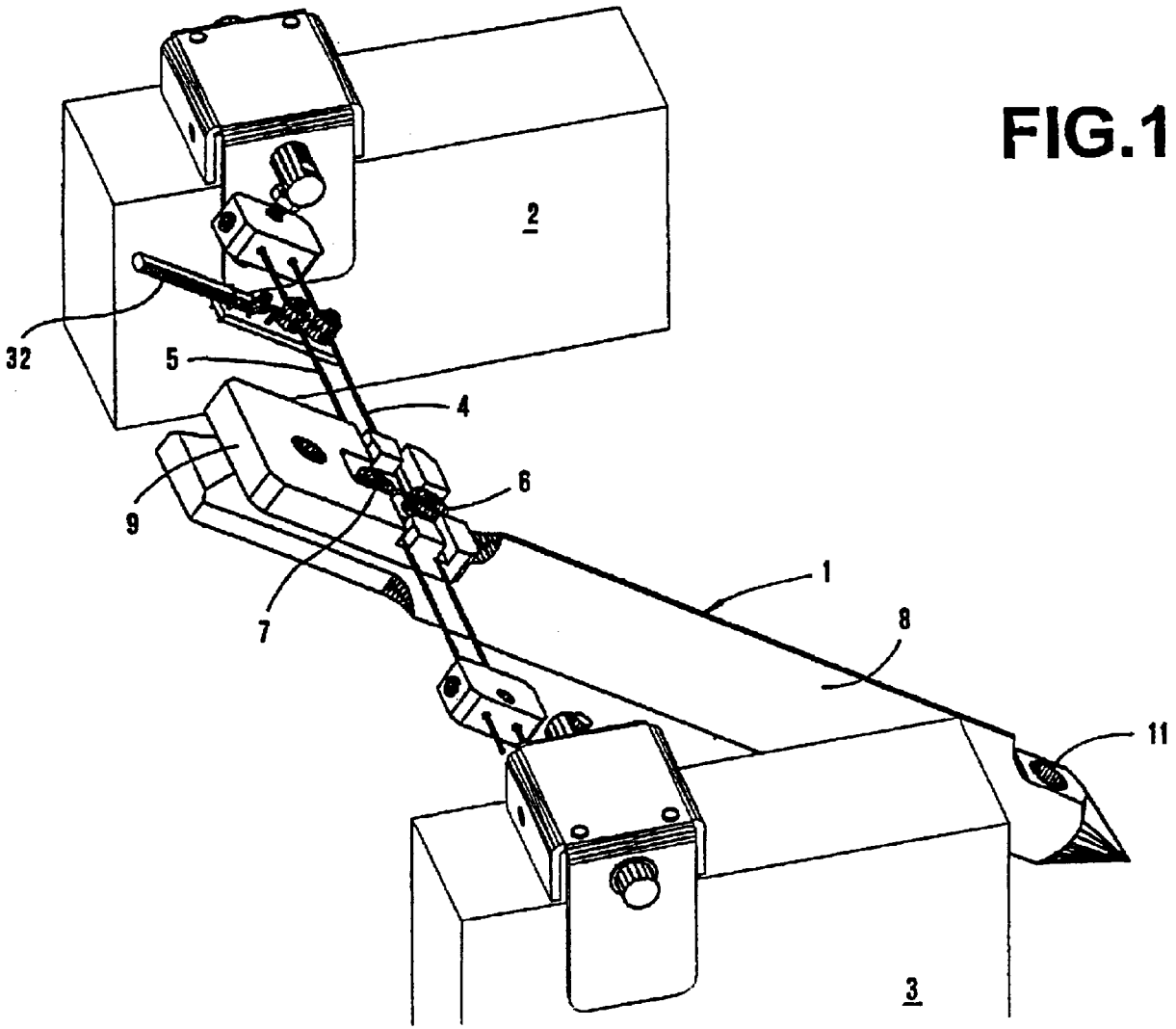
FIG. 1 is a perspective representation of an ink-agitator according to the invention associated with an ink fountain in a security printing machine.

The arrangement shown in FIG. 1 comprises an ink-agitator 1 supported and guided above an ink fountain in such a manner that the tip of the ink-agitator is dipping into the fountain. Such an ink-agitator is known per se. Two supports 2 and 3 are fixed on the lateral walls of the fountain and support a carriage device (not shown) with driving means which imparts to the ink-agitator arrangement 1 a continuous alternate movement between the two supports 2 and 3. Two wires 4 and 5 are connected to the ground and to a direct low voltage source respectively. They feed current, supplied by cable bus 32, through two sliding contacts 6 and 7 respectively to a ferromagnetic ink detector arrangement as will be shown later. The ink-agitator 1 comprises a main body or finger 8 and a holding part 9 both screwed together, these parts being of a non magnetic metal, for example of aluminium or of an aluminium alloy.

Figure 10:
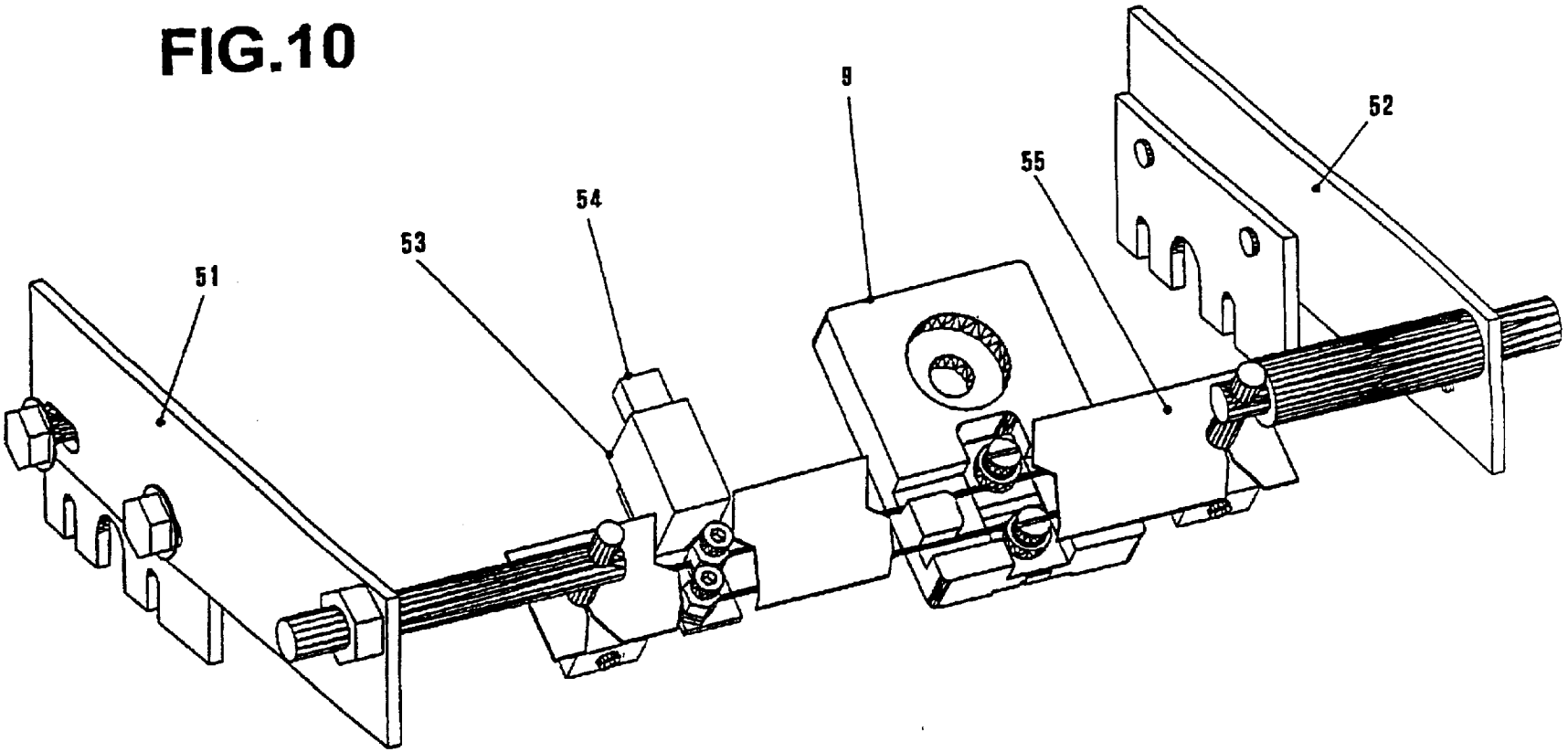
FIG. 10 is a perspective representation of a variant embodiment of the ink-agitator arrangement support.

FIG. 10 shows a variant embodiment of the ink-agitator support arranged to be directly attached to an existing agitator assembly (not shown). Two mounting elements 51 and 52 are provided to attach the device to the existing ink-agitator assembly. Such an arrangement avoids the use of any special mounting support or holes on the machine and enables the system to be mounted in a single operation with the ink-agitator on an existing agitator assembly. A cable connector 53, 54 is provided for receiving the cable bus 32 providing power to and taking the signals from the sensor mounted inside the ink-agitator finger. The arrangement further comprises a protective cover 55 for the power and signal cables to ensure that there is no interruption of signals due to ink accumulation on the wires. The ink-agitator finger, which is not shown in FIG. 10, can be mounted on a holding part 9 similar to that shown in FIG. 1.

Figure 2:
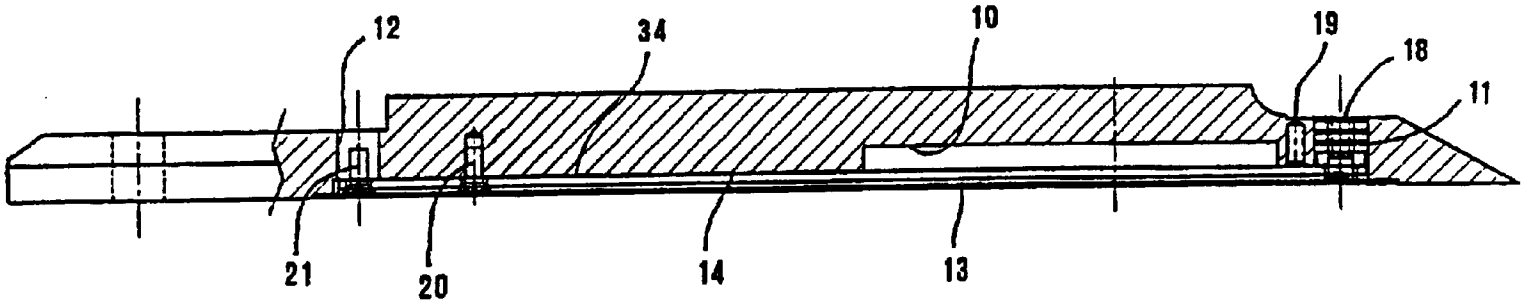
FIGS. 2 and 3 are respectively a cross-sectional and a plane view of the main part of the ink-agitator.
Figure 3:
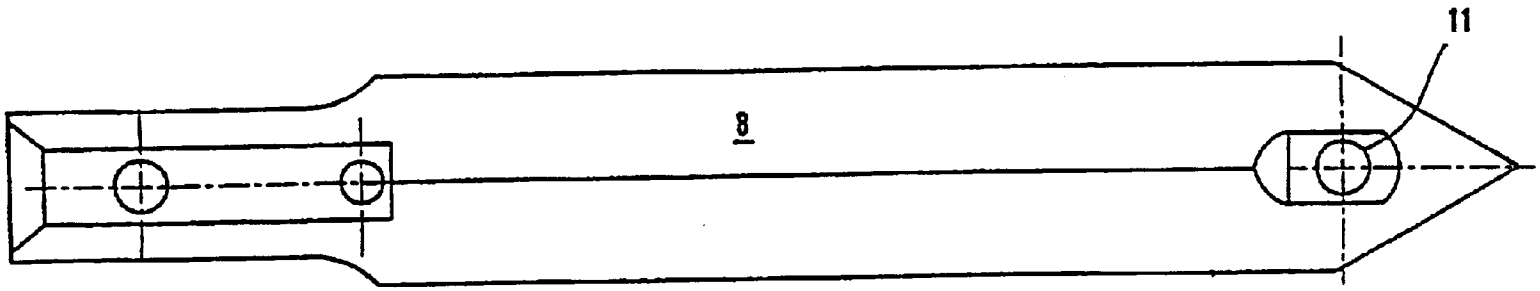

As represented in FIGS. 2 and 3, the finger 8 has a triangular cross-section with a pyramidal tip. Lodgings 34 and 10, intended to lodge a plate 14 bearing a transducer circuit 17, are provided in the lower face of finger 8, and cylindrical borings 11 and 12 cross the whole thickness of finger 8 at both ends of the narrower lodging 34. Lodging 34 is closed and sealed with a bottom thin plate 13.

Figure 4:
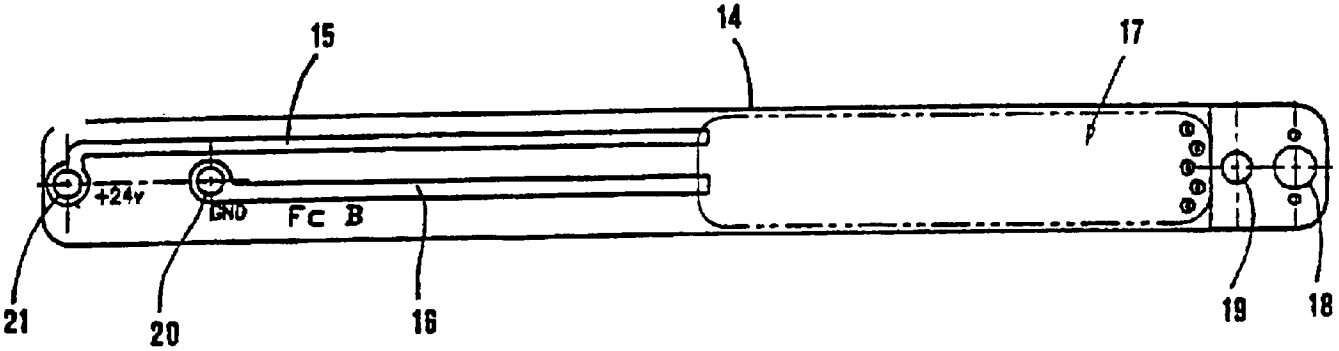
FIG. 4 is a plane view from above of a support plate with printed conductors, bearing a transducer circuit, and fixed to the lower side of the main part of the ink-agitator.
Figure 6:
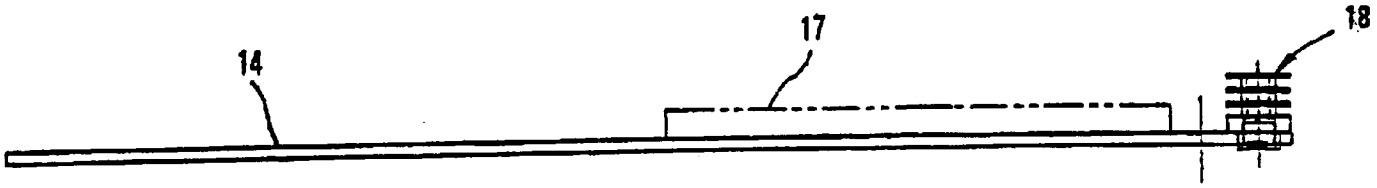
FIGS. 6 and 7 are respectively side and plane views representing schematically the transducer support plate.
Figure 7:
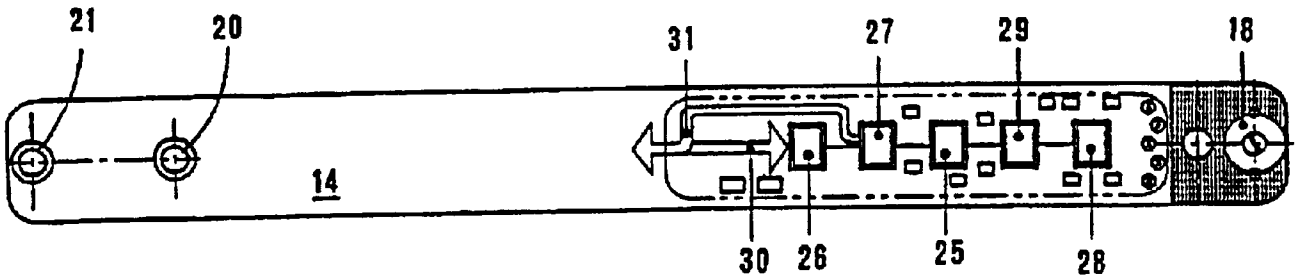

An ink property detector assembly (FIGS. 4, 5, 6) comprises several components mounted on a rigid support plate 14 which is adjusted within the lodging 34. Plate 14 bears a pair of printed isolated copper tracks 15 and 16, a transducer circuit 17 and a transducer head 18 with a ferromagnetic transformer. It follows from FIGS. 2 and 4 that the transducer circuit 17 fills lodging 10 whereas transducer head 18 is lodged inside the boring 11. Plate 14 is secured to the finger 8 through a pin 19 and a screw 20. The latter insures contact connection between the metallic finger 8 and the ground pole of the transducer circuit to be described later. The output connection and direct low voltage feeding contact 21 of the circuit 17 protrudes within boring 12 from where it is connected to a sliding contact arrangement 6. Inversely the ground connection of the circuit 17 is led to a sliding contact 7 bound to the rear end of the metallic finger 8.

According to variant embodiments of the finger 8, partially represented in FIGS. 11 and 12, the transducer head 18 is positioned at the very end part of the finger 8. Said variants allow an ink property detection even when a small quantity of ink is left in the bottom of the ink fountain.

FIGS. 5 to 8 represent the different parts of the transducer.

FIG. 5 is a cross-section through the ferromagnetic transformer detector 18. Nylon body 23 has a cylindrical through-hole 35 with a threaded upper part and an enlarged lower smooth portion. A bolt 24 threaded into hole 35 supports and guide a ferrite core 22 which is thus adjustable in height within hole 35. The outer upper portion of body 23 is provided with three coaxial coils L1, L2, L3 which are connected in the transducer circuit 17 in such a manner that they form a transformer, the primary winding of which is formed through coils L1 and L3 whereas the secondary winding is coil L2.

Such a three coils arrangement has shown to be particularly advantageous compared to the use of other types of transformers, since it is very precise with less influence of outside magnetic materials.

Coils L1 and L3 are connected in such a way as to produce opposed magnetic fields. They are driven by sine wave amplitude stabilised by usual means. The transformer ferrite core induce in the secondary coil L2 an equal opposite EMF (electromotive force) such that a nominally "zero" output is produced at terminals. In an experimental embodiment, coils L1 and L3 had 190 and 210 turns respectively and the "zero" output was obtained through adjusting of the core position in hole 35, depending on the intensity of the magnetic property normally provided by the security ink present in the fountain.

If the physical characteristics of the magnetic ink are changed, the EMF in the secondary coil L2 moves out of balance to produce a net voltage and phase difference across it. The same also happens if a magnetic property inadvertently appears in an ink which should not show such a property. Good transducer performance are strictly related to winding techniques, magnetic shielding material choice and other issues.

The transducer circuit generally designated through the reference numeral 17 is arranged for processing the signals issuing from coil L2. As represented in the block diagram shown on FIG. 7, the transducer circuit comprises a regulator/filter 26 at the inlet 30 of the circuit, a line driver 27, a phase demodulator circuit 25, an oscillator 28 providing the sine wave able to feed the primary coils of the transformer 18. A filter 29 collects the outlet of the secondary coil L2. Output signals issuing from that coil are sent through a phase sensitive demodulation circuit element represented by demodulator 25 and line driver 27, into direct voltage input/output line 15.

The output 31 of the transducer circuit 17 is fed to a control box 33 through wire 4 and a cable bus 32.

Figure 8:
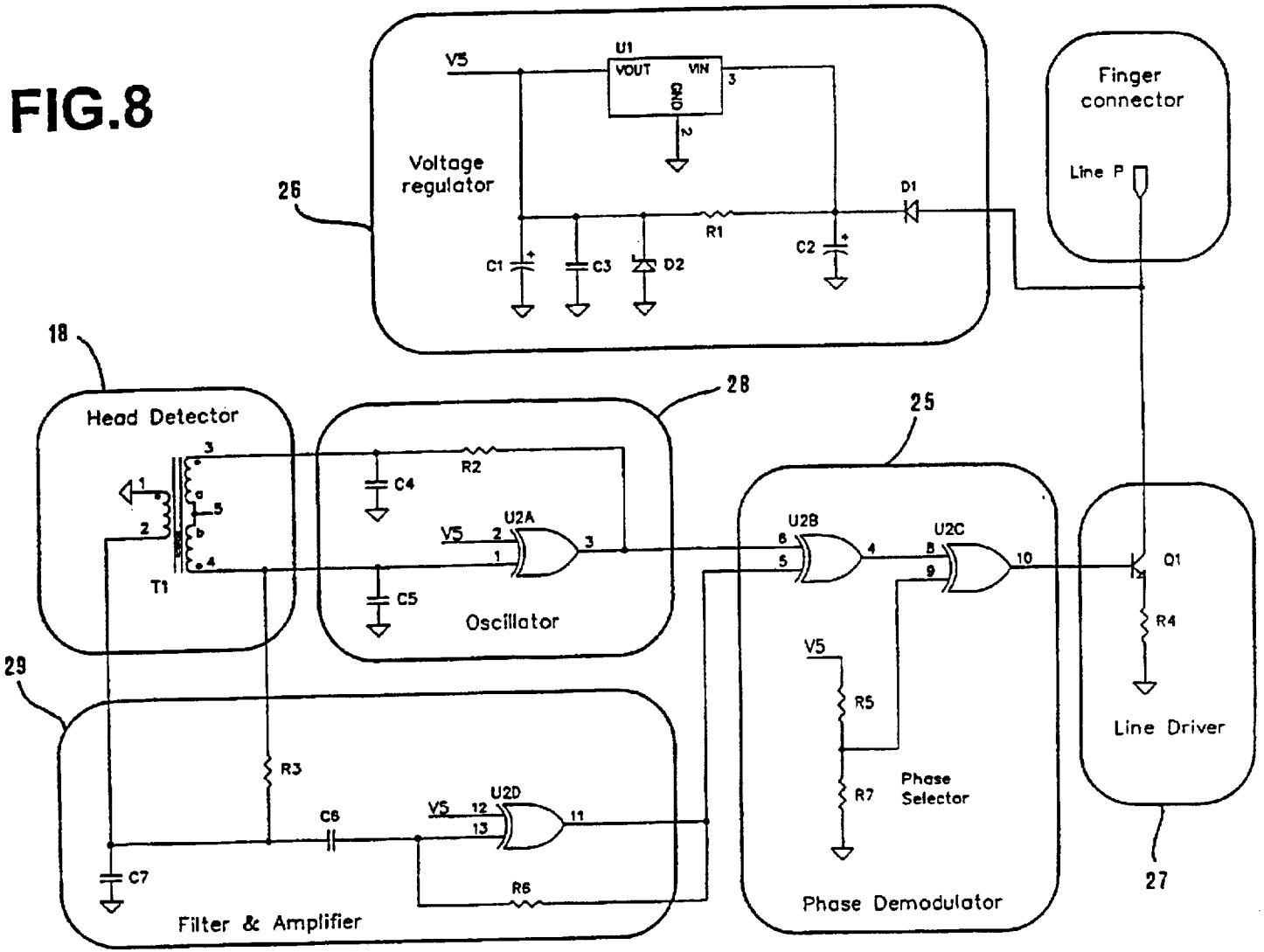
FIG. 8 is a schema of an example of transducer circuit mounted on the transducer support plate.

The schema of an embodiment of transducer circuit is represented by way of example in FIG. 8.

Figure 9:
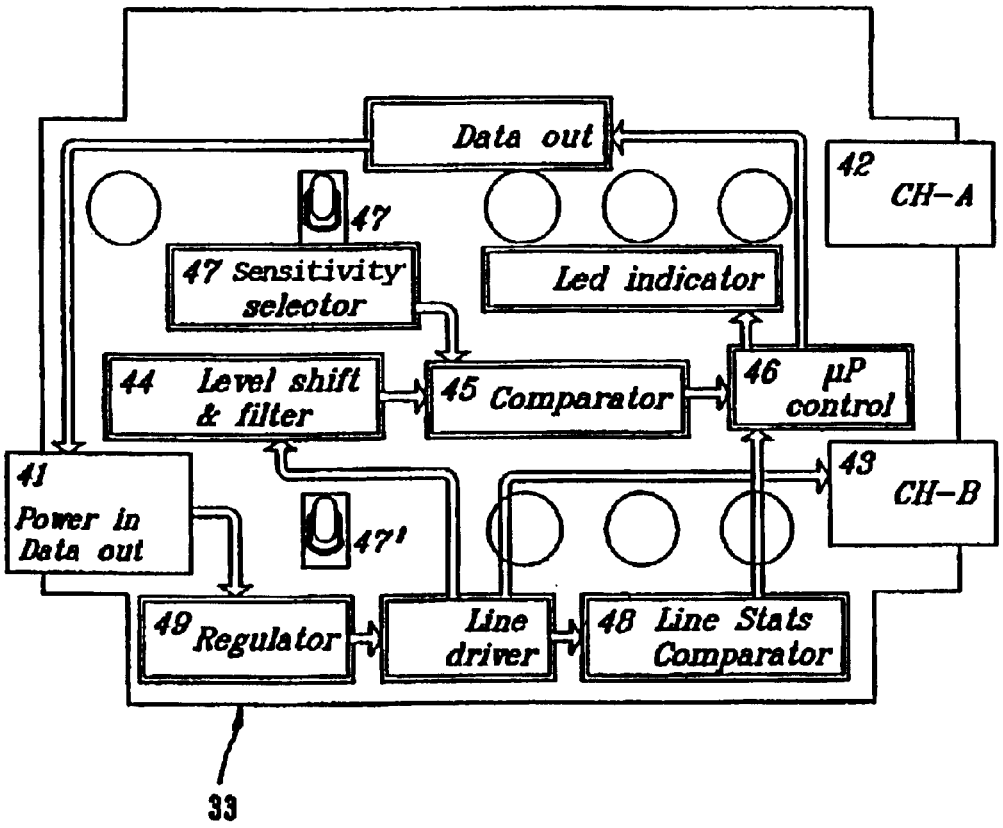
FIG. 9 is a block diagram of an example of control box.

Finally, the control box 33 according to schema of FIG. 9 permits to determine which action a signal sent by the ink detector should start: alert the printer, stop the machines, deviate the "spoiled" sheets to the waste pile, etc. It can also dispatch different orders (CH-A, CH-B) to different detectors associated with a plurality of fountains in a given printing machine, for example two fountains for the control box of FIG. 9.

The control box represented on FIG. 9 has three connectors, one connector 41 for the machine and one connector 42, 43 for each detector. Connector 41 comprises the power supply for the control box and sensor and output signals for the machine control. Block "Line driver" provides the power to the detector head through two sensing resistors. The detector data are transferred to the control box through power lines with for example a 800 KHz square modulated signal. Block "Level Shift and Filter" 44 conditions the signal which comes from the detection line into a logic value. This digital signal is filtered to extract an analog value, depending from its duty cycle, and send it to comparator block 45. Said Comparator block convert analog level into a digital information before passing to a micro-controller 46. The comparator thresholds can be selected by external switches "Sensitivity Selectors" 47, 47'. Other comparator block "Line Stats Comparator" 48 monitor the status of the detector line: operative, open, short-circuited. All this information and all control box output signals (Leds, relay and two open collectors) are controlled by the micro-controller 46. A digital filter inside the micro-controller 46 protects against electrical noise, fast short-circuits or fast signal interruptions on both detector lines.

The main voltage supply is for example 24V DC regulated into control box by two regulators 49: a 12V switching regulator and a 5V liner regulator.

Although a detector of a magnetic property of security ink has been described, similar devices can also be used to monitor other invisible security features such as IR, fluorescence or phosphorescence.

The device as described is designed to be able to be used in all types of security printing machines.

What is claimed is:

1. Device for continuously checking the production of security printing machines equipped with at least one ink fountain containing a security ink provided with an invisible feature, wherein an ink property detector with sensitivity in the range of said security feature is provided into an element placed in said ink fountain, and the outout of said detector is continuously collected and transmitted to a warning device, said detector is integrated to an ink agitator comprising a finger element with a tip extending into the ink fountain, said finger element being continuously displaced in said fountain and the ink property detector having an output connected to the warning device, wherein the detector is further arranged for checking a magnetic property of the security ink, said detector comprising a ferromagnetic transducer connected to a transducer circuit connected itself to a control box, said ferromagnetic transducer comprising a ferrite core and an associated set of coaxial coils, the whole forming a transformer with primary and secondary windings, the secondary winding being constituted by one of said coils connected to the control box through the transducer circuit and a pair of electrical tracks.

2. Device according to claim 1, wherein said ferromagnetic transducer comprises three coils, the primary winding of the transformer being formed by the two end coils, the secondary winding being formed by the third coil.

3. Device according to claim 1, wherein the coils of the ferromagnetic transformer are fixedly mounted on a tubular synthetic support and the ferrite core is adjustable by means of a screw within said support.

4. Device according to claim 2, wherein the coils of the ferromagnetic transformer are fixedly mounted on a tubular synthetic support and the ferrite core is adjustable by means of a screw within said support.

5. Device for continuously checking the production of security printing machines equipped with at least one ink fountain containing ink provided with an invisible security feature, said device comprising an ink agitator arrangement with an agitator finger element continuously displaced relative to said ink fountain and having a tip continuously dipping into said ink in said ink fountain, wherein an ink property detector with sensitivity in the range of said security feature is lodged into said tip and the output of said detector is continuously collected and transmitted to a warning device.

6. Device according to claim 5, wherein the detector is connected to a control box.

7. Device according to claim 6, further comprising fixed guiding means for guiding the displacements of said agitator finger element, said guiding means being provided with a pair of electrical tracks connected to said ink property detector through slide contacts.

8. Device according to claim 7, wherein the detector is arranged for checking a magnetic property of the security ink and its output is connected to a transducer circuit, the latter being entirely located within said finger element and having a pair of electrical output tracks connected to said slide contacts.

9. Device according to claim 8, wherein said magnetic property detector comprises a ferromagnetic transducer.

* * * * *

UNITED STATES PATENT AND TRADEMARK OFFICE

CERTIFICATE OF CORRECTION

PATENT NO. : 6,779,448 B2
DATED : August 24, 2004
INVENTOR(S) : Stephen Brown and Eric Fivaz It is certified that error appears in the above-identified patent and that said Letters Patent is hereby corrected as shown below:

Column 4,
Line 52, please delete "outout" and insert in lieu thereof -- output --.

Signed and Sealed this

Thirtieth Day of November, 2004

JON W. DUDAS
*Director of the United States Patent and Trademark Office*